United States Patent [19]

Goidinger

[11] 4,416,098

[45] Nov. 22, 1983

[54] SLAB-SHAPED BUILDING ELEMENT

[76] Inventor: Johann Goidinger, A-6511 Zams/Österreich, Hinterfeldweg 8, Austria

[21] Appl. No.: 266,282

[22] Filed: May 22, 1981

[30] Foreign Application Priority Data

Jun. 2, 1980 [AT] Austria ..... 2901/80

[51] Int. Cl.[3] ..... E04C 2/04

[52] U.S. Cl. ..... 52/309.16

[58] Field of Search ..... 52/309.12, 600, 606, 52/309.1, 309.16, 747, 605; 521/83, 100

[56] References Cited

U.S. PATENT DOCUMENTS

| | | | |
|---|---|---|---|
| 2,312,293 | 2/1943 | Weiss | 52/600 X |
| 3,156,169 | 11/1964 | Finsterwalder | 52/600 X |
| 3,435,567 | 4/1969 | Tyson | 52/600 X |
| 4,056,910 | 11/1977 | Hiatt et al. | 52/309.1 X |
| 4,125,979 | 11/1978 | McLaughlin | 52/606 X |
| 4,285,179 | 8/1981 | Goidinger | 52/309.12 |
| 4,288,955 | 9/1981 | Hiatt et al. | 52/309.1 |

FOREIGN PATENT DOCUMENTS

| | | | |
|---|---|---|---|
| 2514063 | 10/1975 | Fed. Rep. of Germany | 52/600 |

*Primary Examiner*—J. Karl Bell

*Attorney, Agent, or Firm*—McGlew and Tuttle

[57] ABSTRACT

A building element of lightweight concrete is reinforced by at least one grid of heavy concrete arranged parallel to its lateral side faces, reinforcing rods connected to form a grid are disposed within said heavy concrete grid. Each of said heavy concrete grids, therefore, represents a covering of the reinforcing grid, thereby first obtaining rust protection for the reinforcing rods and, second, the bonding effect between the reinforcing rods and the lightweight concrete. A plastic and elastic expansion characteristic of lightweight concrete is thereby utilized to compensate the high amount of shrinkage of the lightweight concrete adhering to the heavy concrete grids so that the building elements remain free from fissures. The lightweight concrete is able to receive static stresses and is used for the reinforcement of the cells of the heavy concrete grid so that the cross-section of the rods of the heavy concrete grid may be reduced to a minimum. When two heavy concrete grids are provided, they are able to operate like girths for receiving tension and pressure, and the lightweight concrete corresponds to a web connecting the girths.

14 Claims, 9 Drawing Figures

Eig . 9

SLAB-SHAPED BUILDING ELEMENT

BACKGROUND OF THE INVENTION

1. Field of the Invention

The invention relates to a slab-shaped building element, particularly to a wall element of storey height, of light weight concrete reinforced by reinforcing rods.

The reinforcement of building elements of light weight concrete is determined for transport and assembly and may, if suitably dimensioned, provide the further possibility of using such elements as loadbearing building elements.

2. Description of the Prior Art

A load-bearing building element of this kind has, for example, been described in the Austrian Pat. No. 355,271. Such an element is preferably made by using expanded additives, such as polystyrene, expanded clay or the like, and has vertically continuous channels adapted to receive reinforcable in-situ concrete as well as substantially horizontally arranged reinforcing rods terminating at the two vertical side faces in grooves extending over the full height of the element. The grooves of adjacent building elements form together a hollow space which may be filled with in-situ concrete and vertically reinforced.

The weight of such wall elements is substantially lower than the weight of wall elements of heavy concrete and may, hence, constitute complete walls and be put up on the site without great difficulties. Wall elements of lightweight concrete have the further advantage that they provide good heat-insulation and the possibility of prefabricating them with very smooth surfaces so that further treatment will be reduced to a minimum. The described advantages outweigh the higher costs in comparison with wall elements of reinforced concrete.

Difficulties arise from the fact that the bond between the lightweight concrete and the reinforcing rods is not such as known from heavy concrete as the extent of shrinkage after the drying and hardening of the lightweight concrete exceeds the shrinkage of the heavy concrete by a multiple, and the sliding resistance of the reinforcing rods is substantially reduced because of the substantially lower density of the lightweight concrete. The shrinking lightweight concrete, therefore, peels from the reinforcing rods, whereupon the rods become susceptible to rust because of the air which can now enter into the hollow spaces, and the bonding effect is destroyed.

It has further been tried to produce so-called multilayer building elements comprising an intermediate layer of lightweight concrete arranged between two layers of heavy concrete reinforced by two vertical reinforcing rods or wires which may be prestressed, if required (German Pat. No. 803,943). The heavy concrete portion of such elements is relatively great so that the reduction in weight and heat-insulation is lower than with wall elements exclusively made of lightweight concrete.

As described in German Pat. No. 192,927, moulded parts of clay or the like are reinforced by iron inserts disposed in the hollow space of the moulded part. The hollow space is then filled with a hardening material, such as cement, ensuring the bonding effect between the moulded part and the iron insert.

SUMMARY OF THE INVENTION

It is the object of the present invention to provide reinforced building elements of lightweight concrete characterized by high heat-insulation and an amount of heavy concrete which is as low as possible, the reinforcing means being firmly bonded to the lightweight concrete in spite of the high amount of shrinkage of the lightweight concrete so that displacement and the formation of rust are definitely eliminated. The high amount of shrinkage of the light concrete may, as described in the U.S. Pat. No. 4,285,179, be compensated by utilizing the plastic and elastic expansion which is characteristic of lightweight concrete and of practical importance with a modulus of elasticity of less than 80 $kN/cm^2$, provided that the lightweight concrete can be tension-resistantly fixed between the stationary reinforcing rods. As already mentioned, this is impossible by simply embedding the lightweight concrete between the reinforcing rods. Moreover, the building elements of lightweight concrete should have no vertical hollow spaces in their interiors which are to be reinforced on the building site and filled with in-situ concrete so that costs and time will also be saved, when putting them up on the site.

According to the invention, this is achieved by arranging within the lightweight concrete at least one grid of heavy concrete parallel to the side faces of the slab-shaped building element, a reinforcing grid consisting of reinforcing rods being disposed in said grid of heavy concrete.

Hence, the present invention provides an indirect bond between the reinforcing rods and the light-weight concrete, the cover of heavy weight concrete of the reinforcing rods serving as transferring elements. The bonding effect between the reinforcing rods and the grid of heavy concrete is obtained in a conventional manner. The bonding effect between the heavy concrete grid and the surrounding lightweight concrete is also obtained in such manner, particularly if the surface of the heavy concrete grid is not extremely smooth but of usual roughness or has been additionaly roughened. The bonding effect is, however, particularly obtained by inserting lightweight concrete into the grid cells, the lightweight concrete, hence, creating a reinforcing effect in the grid plane. The heavy concrete cover protects the reinforcing rods against rust and forms an excellent reinforcement for transport and assembly so that large-size, pre-fabricated wall elements can also be transported and put up on the site.

A preferred embodiment, which is particularly suitable for load-bearing parts of a building structure, provides that two grids of heavy concrete spaced from each other are enclosed in the lightweight concrete in parallel arrangement, each of said grids of heavy concrete being reinforced by reinforcing rods.

Preferably the distances between the vertical reinforcing rods of each reinforcing grid are smaller than the distances between the horizontal reinforcing rods, at least two rows of concrete pillars of small diameters are disposed parallel to the visible faces of the building element, the pillars being spaced from one another by small distances, replacing the pillars of in-situ concrete which had to be fabricated, in the case of conventional building elements on the building site and taking over their static function.

The parts of lightweight concrete which reinforce, as already mentioned, the grid cells are linked to one another by the surrounding lightweight concrete.

The shrinkage of the lightweight concrete is, therefore, impeded by the heavy concrete grid in both directions of the grid plane so that the tendency to shrinkage must be continuously compensated by the expansion of the lightweight concrete and is actually compensated thereby. The two grids of heavy concrete are able to operate as girths receiving tensile forces and pressure. The lightweight concrete acts like a web connecting the two girths, as the lightweight concrete can be used for receiving horizontal forces in spite of its reduced resistance to static stress, when compared to heavy concrete. This is due to the fact that the transverse forces can disperse over the entire building element.

In order to facilitate the production of such building elements having two grids of heavy concrete, it may further be provided that the two reinforcing grids are linked to each other by spacing means.

In the case of building elements which are exposed to particular stress from transverse forces it is further possible to provide the spacing means between the two reinforcing grids in the form of reinforcing rods which are covered by heavy concrete so that a three-dimensional, reinforces grid of heavy concrete is surrounded by lightweight concrete.

In a further embodiment which has on the upper face an upwardly projecting rim representing the lateral sheathing for a ceiling, it is further provided that one of the reinforcing grids extends into this rim.

Further, building elements employed in corners of a building may comprise grids of heavy concrete projecting over the building element from a vertical side edge. Building elements arranged edge-to-edge contact one another along their vertical longitudinal edges so that a pillar-like space remains free in the region of the corner. The projecting parts of the heavy concrete grid extend into this free space, overlap one another or are linked to one another in any suitable manner. On the building site, the space can be filled with lightweight concrete so that the formation of temperature jumps is prevented. Due to the elastic expansion of the lightweight concrete, crack formation at the corners between the individual building elements is obviated, as the lightweight concrete is tensioned between the rods of the heavy concrete grid. For connecting the building elements with adjacent building elements or with other structural members, it may further be provided that parts of the reinforcing rods project freely on the sides directed towards adjacent building elements. Such parts of the reinforcing rods which project laterally or into building elements have been put up on the site, such connection being obtained by welding, clamps, flanges etc. Then, the joints are covered with sprayed concrete, and the interspaces or recesses are filled with lightweight concrete.

The method of manufacturing building elements according to the invention may be very simple. Welded wire meshes of suitable dimensions are inserted into a grid-type concrete sheathing mould, whereupon heavy concrete is inserted. After the hardening of the concrete, a grid of heavy concrete is disposed in a sheathing form into which lightweight concrete is inserted.

For load-bearing building elements, two grids of heavy concrete spaced from each other, preferably by spacing members, are disposed in a sheathing form into which lightweight concrete is inserted. If transverse reinforcing rods should additionally be provided between the two reinforcing grids, i.e. a three-dimensional grid structure of heavy concrete is to be produced, the additional reinforcing rods can be linked to rods of the reinforcing grids in certain places which have not been covered by the cover of heavy concrete. Then, said additional reinforcing rods are also covered with sprayed concrete, and the further manufacturing process corresponds to the one described above.

Reinforced heavy concrete rods may also be used as spacing members. Such rods are provided with grooves spaced from one another by the distance between the two heavy concrete grids, the breadth of said grooves corresponding to the breadth of the rod of the heavy concrete grid, said heavy concrete rods being pushed onto opposite rods of the two heavy concrete grids.

BRIEF DESCRIPTION OF THE DRAWINGS

The present invention will be described in more detail, by way of example only, with reference to the accompanying drawings, in which:

FIG. 9 is a top view of a corner structure.

DESCRIPTION OF THE PREFERRED EMBODIMENTS

Figure 1:
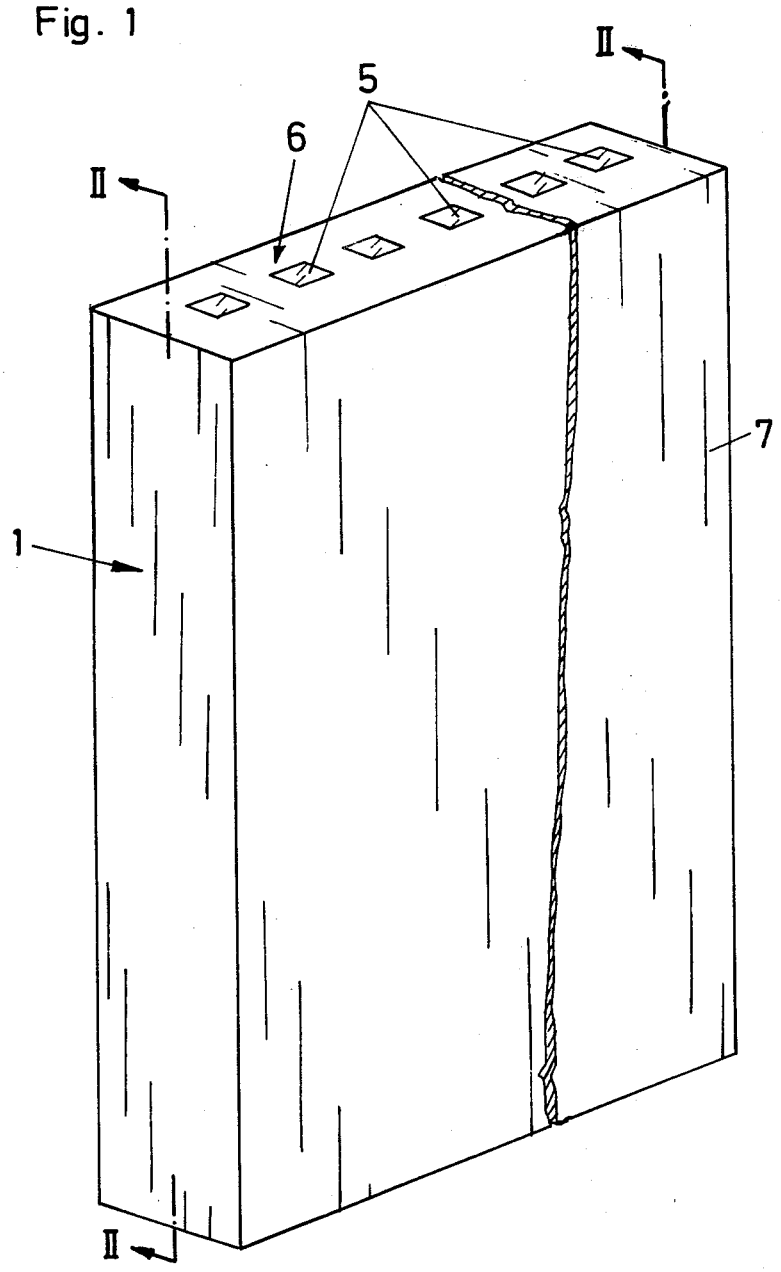
FIG. 1 is an oblique view of a building element according to the invention.
Figure 2:
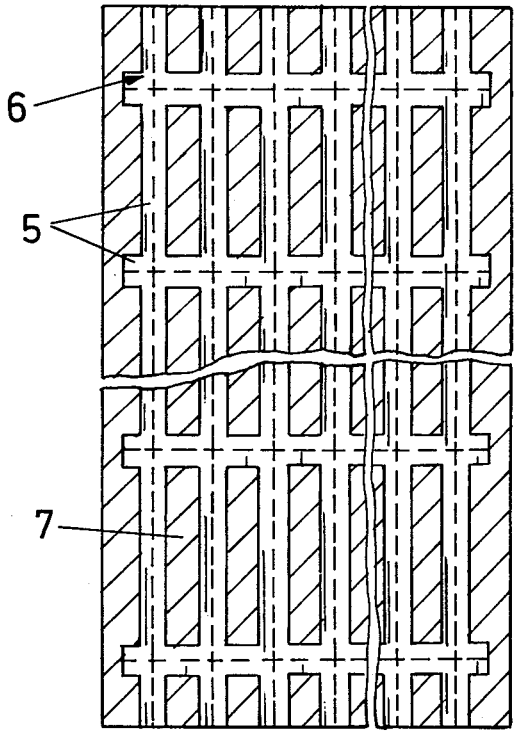
FIG. 2 is a section along line II—II of FIG. 1.

FIG. 1 shows an oblique view of a building element 1 according to the invention of a one story height. An essential part thereof made of lightweight concrete 7 and, the length of the building element 1 may be several meters. As can also be seen in FIG. 2, which shows an asymetric longitudinal sectional view of the building element 1, there is provided in its inside a grid 6 of heavy concrete arranged parallel to its visible faces. Reinforcing rods 3, 4 of constructional steel, welded wire meshes in particular, are enclosed therein in grid arrangement. Hence, the reinforcing rods 3, 4 are provided with a cover or jacket 5 of heavy concrete forming the heavy concrete grid 6. Said cover 5 further protects the reinforcing rods against rust and transfer the bond between the reinforcing rods 3, 4 and the lightweight concrete 7.

The cross-section of the cover 5 is obviously not restricted to the illustrated rectangular shape. The lightweight concrete 7, which is manufactured particularly by employing expanded additives, e.g. polystyrene particles, encloses all sides of the heavy concrete grid 6, serves for heat-insulation and keeps the weight of the building element low. The enclosed reinforcing grid of heavy concrete serves, above all for transport and assembly so that very large building elements, e.g. entire walls, may be pre-fabricated, transported and put up on the site. It may also serve as a load-bearing reinforcement but only to a limited extent.

Figure 3:
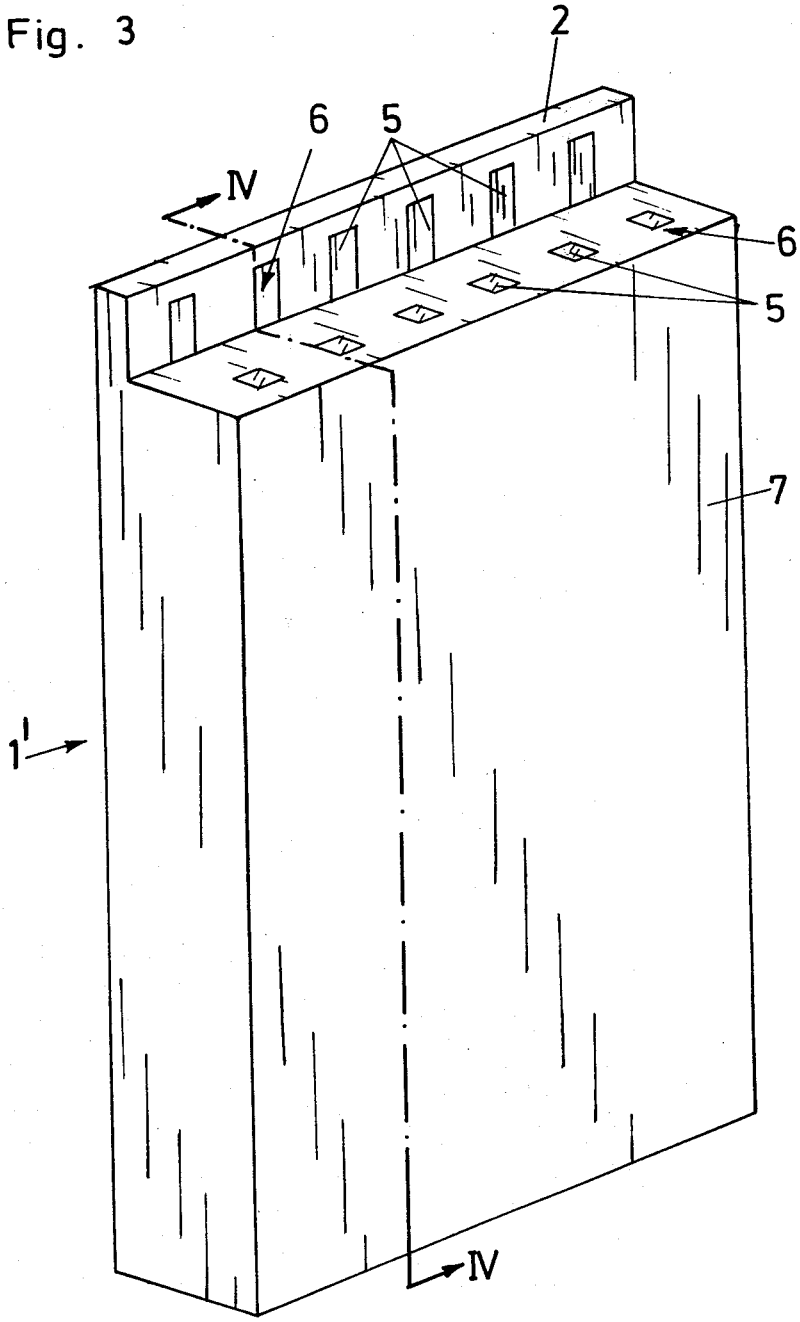
FIG. 3 is an oblique view of a further embodiment.
Figure 4:
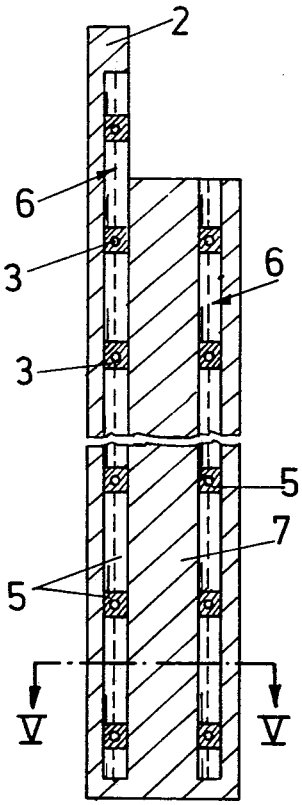
FIGS. 4 and 5 are sections along lines IV—IV of FIG. 3 and V—V of FIG. 4, respectively.

FIG. 3 shows an embodiment of a building element 1' for external load-bearing walls. The upper horizontal surface of the building element 1' is provided with an upwardly projecting rim 2 representing the lateral sheathing for the ceiling that lies on said upper horizontal surface. The load-bearing reinforcement, which is also sufficient for greater loads, is obtained by two heavy concrete grids 6 spaced from one another, if desired by spacing means which have not been illustrated, and disposed inside the building element in parallel arrangement. As can be seen in FIG. 4, reinforcing rods 3, 4 are enclosed in said grids 6. The surrounding lightweight concrete 7 reinforces the building elements 1' not only in the planes of the heavy concrete grid 6 but also vertically thereto, as the lightweight concrete may be exposed to static stress and acts particularly against occuring transverse forces. Tests have shown that such walls having a thickness of 25 cm and provided with two grids 6 of reinforced concrete having a cross-section of 5×5 cm are able to receive loads up to 100,000 kg per running meter.

Figure 5:
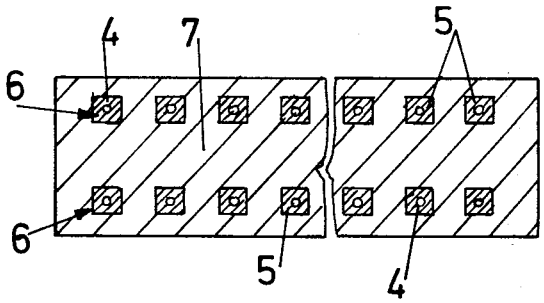

The interspaces between the vertical reinforcing rods 4 are relatively small as they serve, above all, for the compressive reinforcement of the building element, whereas the horizontal reinforcing rods 3 may be arranged at greater interspaces. As can be seen in FIG. 5, the vertical rods of the heavy concrete grid 6 form a multitude of small concrete pillars, whereby the stress to cracks is transferred to the surrounding lightweight concrete 7 receiving said stress. The external one of said two heavy concrete grids extends partly into the rim 2 in which it also serves as a transport reinforcement for said rim 2, which easily breaks.

Figure 6:
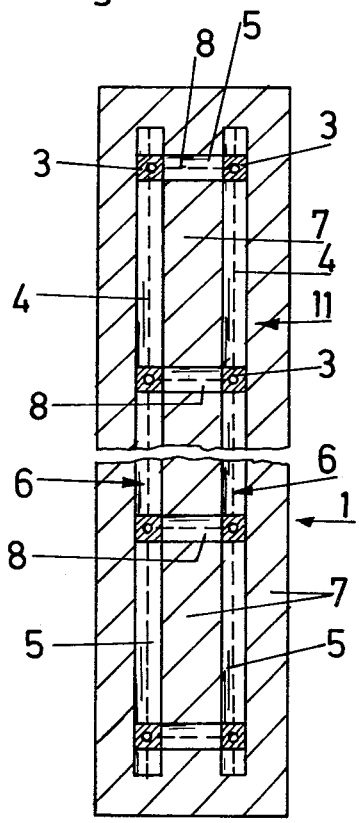
FIG. 6 is a section according to FIG. 4 of a further embodiment.

FIG. 6 shows a cross sectional view of a further embodiment in which a three-dimensional heavy concrete grid 11 is enclosed in the lightweight concrete. The two grids 6 of heavy concrete are linked by transverse members. Said transverse members consist of reinforcing rods 8, which are linked to the reinforcing rods 3, 4, e.g. welded thereto, and are also provided with a cover 5 of heavy concrete.

Figure 7:
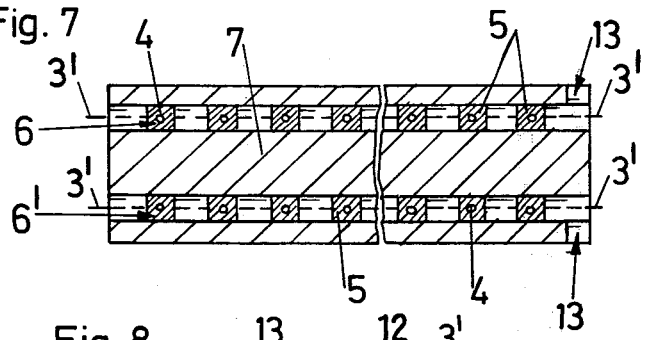
FIG. 7 is a horizontal sectional view of a further embodiment.

FIG. 7 shows a further embodiment of a building element in which end portions 3' of the reinforcing rods 3 project laterally from the building element and are not surrounded by heavy concrete, i.e. they are uncovered. It is obvious that freely projecting end portions of the reinforcing rods 4 may also be provided.

Figure 8:
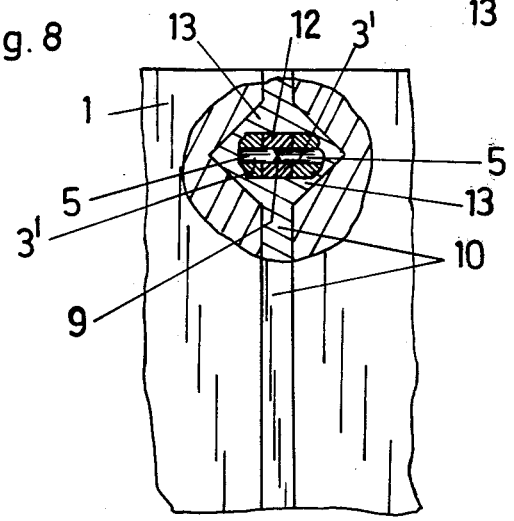
FIG. 8 is a section of a joint region of two adjacent building elements according to FIG. 7.
Figure 8:
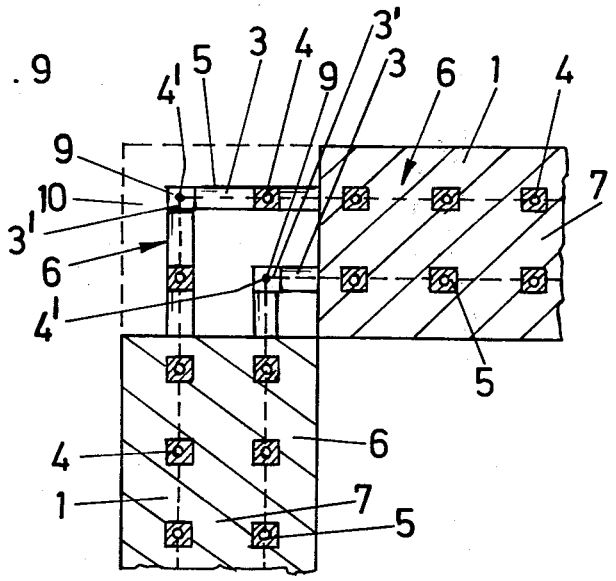

The freely projecting end portions 3' serve as a connection between the reinforcing grids and, hence, of the building elements 1, 1' or between the building elements and other parts of the construction. The freely projection end portions 3' of two building elements 1 may, according to FIG. 8, be welded together or linked in any other suitable manner. The joint 9 is subsequently covered with sprayed concrete 12 to protect it against rust, and the residual interspace is filled with a filling material 10, e.g. lightweight concrete.

Hence, such joints of the elements substantially correspond to the cross-sectional structure inside the building element. In the building element, recesses 13 may also be provided in the region of the freely projecting end portions 3'. Such recesses make the joints 9 more easily accessible and because of them the breadth of the joint may be small.

In the embodiment illustrated in FIG. 9, building elements 1 according to the invention are arranged to form a corner. The building elements provided for such purpose comprise grids 6 of heavy concrete projecting from a vertical face. Said projecting parts of the heavy concrete grids 6 may overlap one another, touch one another, as illustrated in the drawing, or also partly engage one another. In this embodiment, it is of particular advantage if the cover 5 of heavy concrete does not cover the end portions 3' of the reinforcing rods 3 and portions 4' of the reinforcing rods 4 so that they may be directly linked, particularly welded together. The joints 9 are then covered with heavy concrete in order to protect them against rust. The projecting portions of the heavy concrete grid 6 may also be linked by connecting members, such as clamps of rust-resisting material, embracing the cover 5. Such connecting members have, however, not been illustrated in the drawings. The pillar-shaped space in the corner may be filled with a filling material on the building site, preferably by casting or spraying lightweight concrete for forming corners of a building, it is also possible to employ building elements with laterally projecting rims similar to the one illustrated in FIG. 3, said rims then forming the sheathing of the corner. The cover 5 of the reinforcing rods 3, 4 of heavy concrete ensures the known bond of the reinforced concrete, and the lightweight concrete 7 forms together with the cover 5 a connection which receives transverse and tensile forces. Hence, an indirect bond between the lightweight concrete 7 and the reinforcing rods 3, 4 is obtained, thus, creating a reinforced building element of lightweight concrete which may be exposed to static stress.

The bond between the lightweight concrete and the cover 5 of heavy concrete remains free from fissures over time, as the plastic and elastic expansion characteristic of lightweight concrete is utilized to compensate the relatively great shrinkage of the lighweight concrete which is prevented by the tension-resistant bond to the heavy concrete grid.

The heavy concrete grids 6 which, as illustrated in FIG. 9, project at one side of the building element 1 to form the corner of a building may also project at the two vertical side edgs of the building element. This is particularly the case, when the building elements 1 have the length of a room so that a corner is formed on both sides. Heavy concrete grids 6 projecting on both sides may, however, also be used for connecting two building elements 1 arranged side by side. By suitably dimensioning and arranging the reinforcing rods 3, 4, building elements 1 according to the invention may also be employed as ceiling- or roof elements. In such cases, it may be of advantage if the reinforcing rods 3, 4 surrounded by heavy concrete project at three or at all four side edges of the building element 1. When the building elements according to the invention are manufactured as wall elements, openings for windows and doors are already provided during manufacture. Frames may already be inserted during manufacture, and lines and pipes may also already be laid in the pre-fabricated elements.

In the following a preferred embodiment will be described:

For manufacturing load-bearing external wall elements with a thickness of 25 cm, two welded wire meshes with a wire cross-section of 3 mm are used, the distances between the wires being 10 cm and 30 cm. The welded wire meshes are in a mould provided with a cover of heavy concrete, said cover having a cross-section of 4×5 cm. Hence, the two heavy concrete grids form cells of 5×25 cm. They are inserted into the sheathing mould for the building element in such a manner that the reinforcing rods lying close to one another form the vertical rods 4, and that the distance between the two heavy concrete grids is 11 cm. The lightweight concrete is made according to the following recipe:

A mixture of:

Portland cement P 275: 240 kg

Calcium hydroxide: 50 kg

Water: 180 l

Foamed polystyrene particles: 1200 l yield 1 $m^3$ of lightweight concrete having a weight of between 380 and 400 kg and a modulus of elasticity of 50 $kN/cm^2$. The thus manufactured building elements reinforced with grids of heavy concrete have a weight of about 135 kg per $m^2$ wall surface, if the thickness amounts to 25 cm. If the height is 270 cm and the length, for example, 500 cm (13.5 $m^2$ wall surface), their weight amounts to about 1820 kg. Hence, they can easily be lifted and displaces by automobile cranes (comparative figure for a wall of heavy concrete of the same dimensions: about 8100 kg). The wall elements further have a heat transition coefficient of 0.58 $W/m^2K$ and, hence, excellent heat-insulating properties. With 4 workers and an automobile crane, about 50 running meters of wall of pre-fabricated elements of the described size may be put up on the site on one day.

Building elements according to the invention may also be made of different lightweight concretes, e.g. glass concrete, foamed concrete, of concrete with expanded clay, pumice slag, perlites or other additives.

What is claimed is:

1. A slab-shaped building element, particularly a wall element of a one story height, of lightweight concrete reinforced by reinforcing rods, wherein at least one grid of heavy concrete is enclosed in said lightweight concrete parallel to side faces of said building element, a reinforcing grid consisting of reinforcing rods being disposed in said grid of heavy concrete, said lightweight concrete being bonded directly to said heavy concrete grid.

2. A building element according to claim 1, wherein on sides of said element to be directed towards adjacent building elements portions of said reinforcing rods project freely to provide a connection between said building elements.

3. A building element according to claim 1, wherein two of said grids of heavy concrete are enclosed in said lightweight concrete in parallel arrangement and spaced from one another, a reinforcing grid being disposed in each of said grids of heavy concrete.

4. A building element according to claim 3, wherein said two reinforcing grids are linked to each other by spacing means.

5. A building element according to claim 4, wherein said spacing means are formed by reinforcing rods, said rods also having a cover of heavy concrete.

6. A building element according to claim 3, wherein the distance between the vertical reinforcing rods of each of said reinforcing grids is smaller than the distance between the horizontal reinforcing rods.

7. A building element according to claim 3, wherein one of said reinforces grids of heavy concrete extends into a rim upwardly projecting from the upper horizontal surface of said building element.

8. A building element according to claim 3, wherein on the sides directed towards adjacent building elements portions of said reinforcing rods project freely to provide a connection between said building elements.

9. A slab-shaped building element, particularly a wall element of storey-height, of lightweight concrete reinforced by reinforcing rods projecting from at least one edge directed to an adjacent building element, wherein at least one grid of heavy concrete is enclosed in said lightweight concrete parallel to the side faces of said building element, a reinforcing grid consisting of reinforcing rods being disposed in said grid of heavy concrete, said grid of heavy concrete also forming a cover for said projecting reinforcing rods.

10. A building element according to claim 9, wherein on the sides directed towards adjacent building elements portions of said reinforcing rods project freely to provide a connection between said building elements.

11. A slab-shaped building element having side faces and side edges, comprising:

a plurality of horizontally spaced vertical steel reinforcing rods lying in a plane substantially parallel to and between the side faces;

a plurality of vertically spaced horizontal steel reinforcing rods substantially lying in said plane and crossing said vertical rods, said horizontal rods connected to said vertical rods at crossing points therebetween;

said vertical and horizontal reinforcing rods forming a steel reinforcing grid;

a heavy concrete grid disposed around, enclosing and directly bonded to said steel reinforcing grid, said heavy concrete grid having horizontally spaced vertical members and crossing vertically spaced horizontal members, each of said vertical and horizontal members having widths and thicknesses which are small with respect to a thickness of the building element between the side faces; and lightweight concrete disposed around, enclosing and bonded directly to said heavy concrete grid, filling spaces between said vertical and horizontal members and the space between the side faces and side edges;

whereby load applied to the slab-shaped building element is distributed from said lightweight concrete to said directly bonded heavy concrete grid and from said directly bonded heavy concrete grid to said directly bonded steel reinforcing grid.

12. A building element according to claim 11, wherein the horizontal spacing of said vertical reinforcing rods is smaller than the vertical spacing of said horizontal reinforcing rods.

13. A building element according to claim 12, including a second steel reinforcing grids comprising a second plurality of vertical steel reinforcing rods and a second plurality of horizontal steel reinforcing rods formed and connected in a manner similar to said first mentioned plurality of vertical and horizontal reinforcing rods, said second steel reinforcing grid having a second heavy concrete grid disposed around, enclosing and bonded to said second steel reinforcing grid, said second heavy concrete grid spaced from said first mentioned heavy concrete grid and lying in a second plane substantially parallel to said first mentioned plane between the side faces, said lightweight concrete disposed around, enclosing and directly bonded to said second heavy concrete grid.

14. A building element according to claim 13, including spacer means connecting and maintaining a spacing between said first mentioned and second heavy concrete grid, said spacer means each including an additional steel reinforcing rod connected between steel reinforcing rods of said first mentioned and additional steel reinforcing grids, and heavy concrete grid members disposed around, enclosing and directly bonded to said additional steel reinforcing rods and directly connected between said first mentioned and second heavy concrete grids.

* * * * *